US006320926B1

(12) United States Patent
Yamagishi

(10) Patent No.: US 6,320,926 B1
(45) Date of Patent: Nov. 20, 2001

(54) COUNTER FOR GAME MACHINE

(75) Inventor: Junichi Yamagishi, Sendai (JP)

(73) Assignee: Unirec Co., Ltd. (JP)

( * ) Notice: Subject to any disclaimer, the term of this patent is extended or adjusted under 35 U.S.C. 154(b) by 0 days.

(21) Appl. No.: 09/539,585

(22) Filed: Mar. 31, 2000

(30) Foreign Application Priority Data

Oct. 19, 1999 (JP) ..... 11-296234

(51) Int. Cl.[7] ..... G06M 11/00
(52) U.S. Cl. ..... 377/7; 377/6
(58) Field of Search ..... 377/5, 6, 7

(56) References Cited

U.S. PATENT DOCUMENTS 5,530,730 * 6/1996 Takemoto et al. ..... 377/7

FOREIGN PATENT DOCUMENTS 11-134468 5/1999 (JP) .

* cited by examiner

*Primary Examiner*—Margaret R. Wambach
(74) *Attorney, Agent, or Firm*—John S. Pratt, Esq.; Kilpatrick Stockton LLP

(57) ABSTRACT

A counter is used to count tokens in a pusher-type game machine. The counter has a sensor unit (25) arranged in a path (23) through which tokens (19) fall. The sensor unit is a part of a capacitance sensor (51) for detecting a capacitance change in the path. A reference capacitance change corresponding to a single token failing through the path is stored in an MPU (47) in advance. A capacitance change detected by the capacitance sensor is compared with the reference capacitance change, to determine the number of tokens failing through the path.

16 Claims, 7 Drawing Sheets

COUNTER FOR GAME MACHINE

BACKGROUND OF THE INVENTION

1. Field of the Invention

The present invention relates to a counter for counting falling tokens and a game machine provided with the counter and played with tokens.

2. Description of the Related Art

FIG. 1 shows a counter for counting tokens according to a prior art disclosed in, for example, Japanese Unexamined Patent Publication No. 11-134468. The counter has a rotary disk 1 onto which tokens 3 are fed. The disk 1 feeds the tokens 3 into a discharge port 5 by centrifugal force. The tokens 3 at the discharge port 5 are aligned and transferred through a path 7 to a counting sensor 9, which counts the number of the tokens 3. This counter is installed in, for example, a slot machine, to correctly grasp a payout ratio, i.e., the ratio of tokens inserted by players into the slot machine to tokens awarded to players, so that the slot machine is properly controlled to promote wholesome playing without boring players or unnecessarily increasing a gambling aspect.

When applied to a pusher-type game machine, this may lose player's excitement and interest.

The pusher-type game machine has a table on which many tokens are present, and a slider that reciprocates behind the tokens on the table. A player inserts a token into the game machine, and the inserted token randomly falls on the table so that, due to the inserted token, the tokens on the table may be pushed forward by the slider and may fall from a front end of the table. The tokens fallen from the table gather at a return mouth. The player may enjoy the sound made by the falling tokens.

In the pusher-type game machine, the number of tokens to be returned to a player must be counted before the tokens reach the return mouth, and the counter mentioned above is incapable of achieving this.

SUMMARY OF THE INVENTION

An object of the present invention is to provide a counter for counting the number of objects that randomly fall and a pusher-type game machine provided with the counter.

In order to accomplish the object, a first aspect of the present invention provides a counter having a capacitance sensor, a reference memory, and an operation unit. The capacitance sensor has a sensor unit arranged in a path where uniform objects fall, to detect a capacitance change in the path. The reference memory stores a reference capacitance change that occurs when a single object falls through the path. The operation unit compares a capacitance change detected by the capacitance sensor with the reference capacitance change and determines the number of objects falling through the path according to a result of the comparison.

According to a second aspect of the present invention, the operation unit compares a total capacitance change detected by the capacitance sensor with the reference capacitance change.

According to a third aspect of the present invention, the operation unit extracts singular points from a total capacitance change detected by the capacitance sensor, counts the number of the extracted singular points, compares the total capacitance change with the reference capacitance change, and determines the number of falling objects according to the counted number and a result of the comparison.

A fourth aspect of the present invention provides a counter having a capacitance sensor and an operation unit.

The capacitance sensor has a sensor unit arranged in a path through which uniform objects fall, to detect a capacitance change in the path. The operation unit extracts singular points from the detected capacitance change, counts the number of the extracted singular points, and determines the number of the objects falling through the path according to the counted number.

According to a fifth aspect of the present invention, the sensor unit of the capacitance sensor consists of a long dielectric base having a specified dielectric constant and electrodes attached to the dielectric base along the length thereof.

According to a sixth aspect of the present invention, the path is defined along a token falling edge of a table in a game machine, and the sensor unit of the capacitance sensor is arranged at the token falling edge. In this case, the objects to be detected by the capacitance sensor are tokens, which are pushed and dropped from the token falling edge of the table, and the capacitance sensor detects a capacitance change in the path due to the falling tokens.

According to the first aspect, the capacitance sensor detects a capacitance change in the path when uniform objects fall through the path. The reference memory stores a reference capacitance change that occurs when a single object falls through the path. The operation unit compares a capacitance change detected by the capacitance sensor with the reference capacitance change and determines the number of objects falling through the path according to a result of the comparison. In this way, the counter of the first aspect is capable of counting uniform objects that fall in front of the capacitance sensor.

According to the second aspect, the operation unit compares a total capacitance change detected by the capacitance sensor with the reference capacitance change and finds a multiple of the reference capacitance change with respect to the total capacitance change, to more correctly count the number of falling objects.

According to the third aspect, the operation unit extracts singular points from a total capacitance change detected by the capacitance sensor, counts the number of the extracted singular points, compares the total capacitance change with the reference capacitance change, and more correctly determines the number of falling objects according to the counted number and a result of the comparison.

According to the fourth aspect, the operation unit extracts singular points from a capacitance change detected by the capacitance sensor, counts the number of the extracted singular points, and determines the number of falling objects according to the counted number.

According to the fifth aspect, the sensor unit of the capacitance sensor consists of a long dielectric base having a specified dielectric constant and electrodes attached to the base along the length thereof The sensor unit may be cut to a required length, to improve the versatility thereof.

According to the sixth aspect, the counter counts tokens that are pushed and randomly dropped from a token falling edge of a table in a pusher-type game machine. Since the counter is capable of counting falling tokens, the counter never spoils a player's paid-out feeling. The counter is capable of properly managing a payout ratio without boring players or unnecessarily increasing a gambling aspect.

DESCRIPTION OF THE PREFERRED EMBODIMENTS

Figure 1:
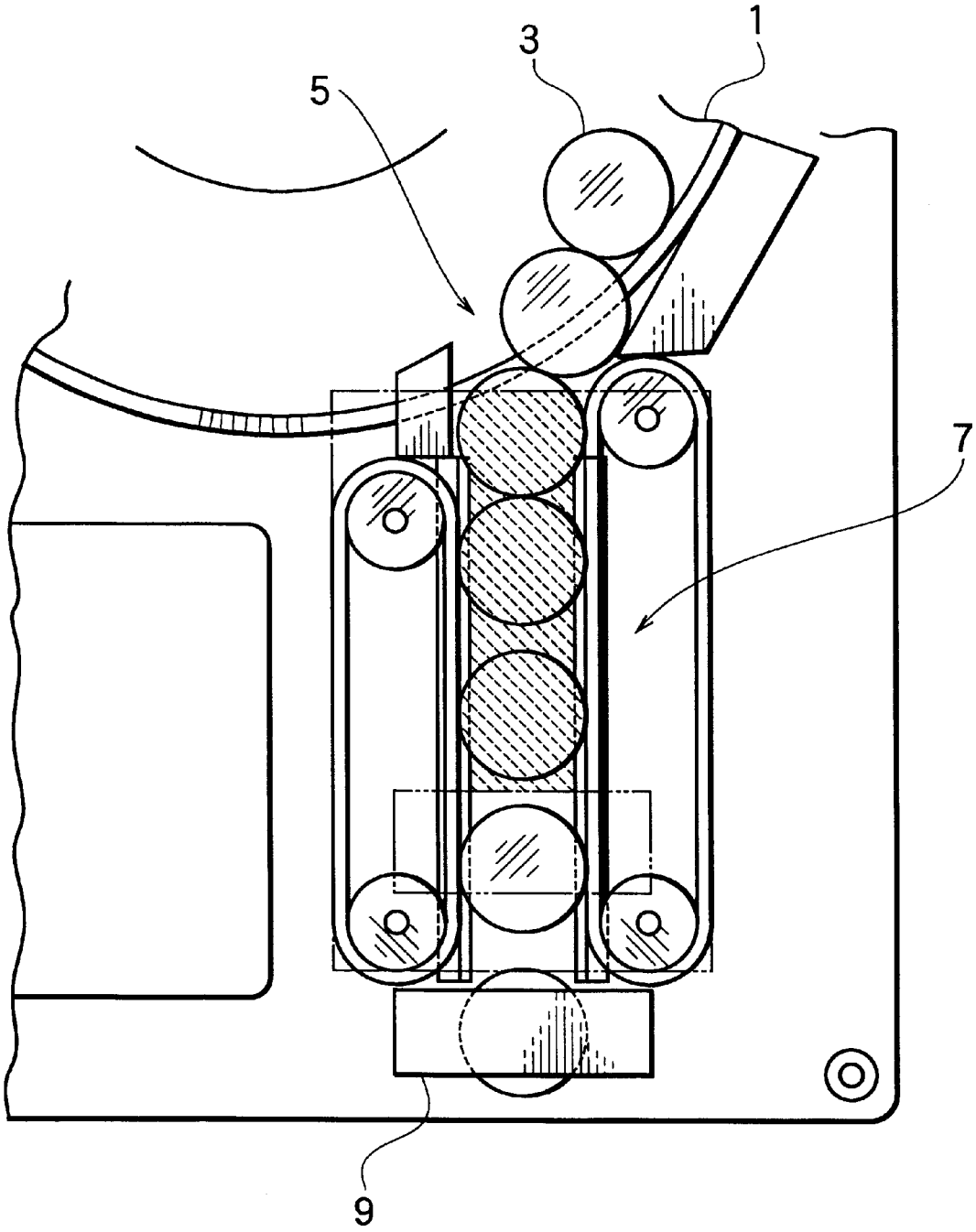
FIG.1 RELATED ART
FIG. 1 is a front view showing an essential part of a counter according to a related art.
Figure 2:
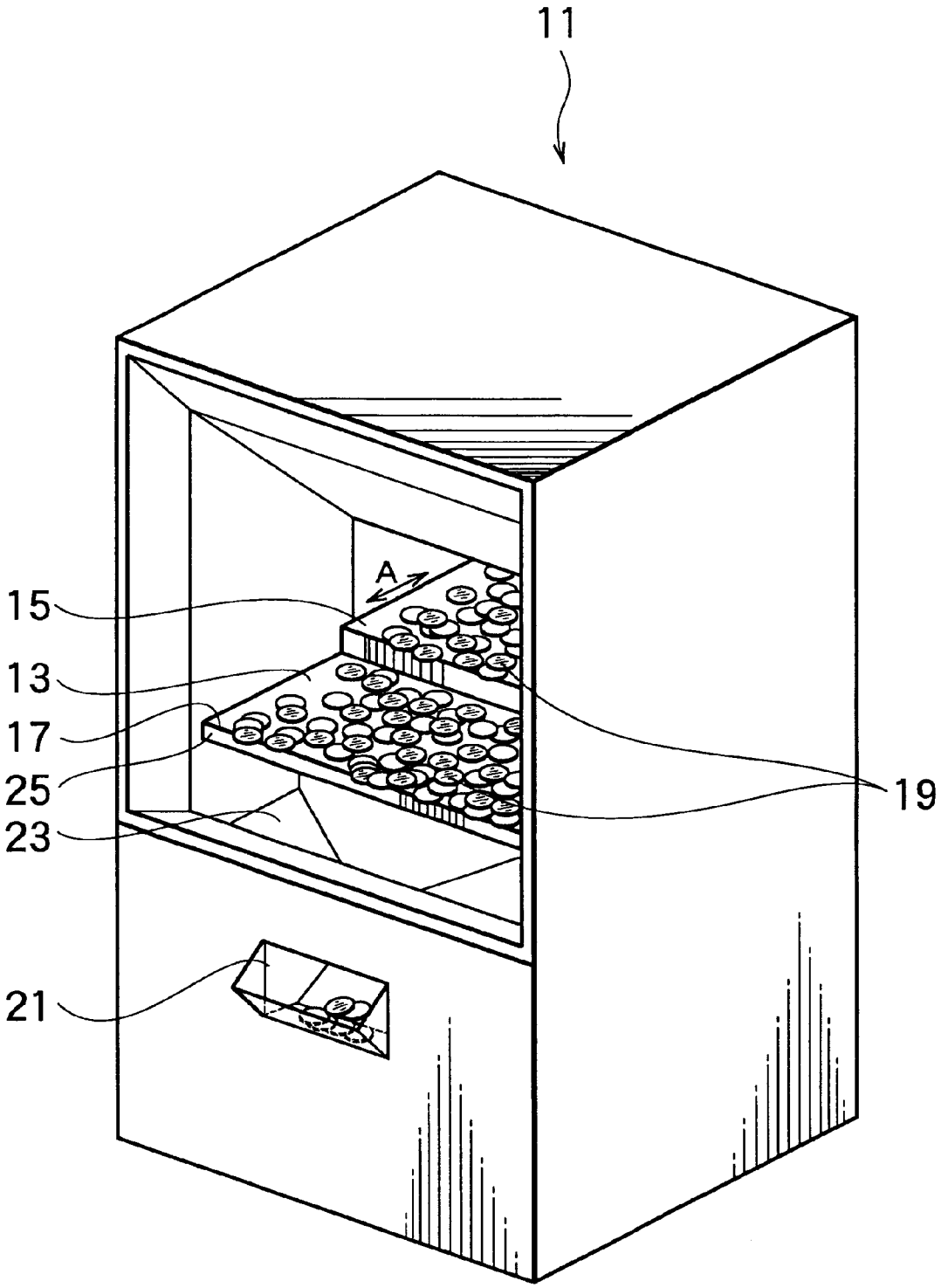
FIG. 2 is a perspective view showing a game machine according to an embodiment of the present invention.
Figure 3:
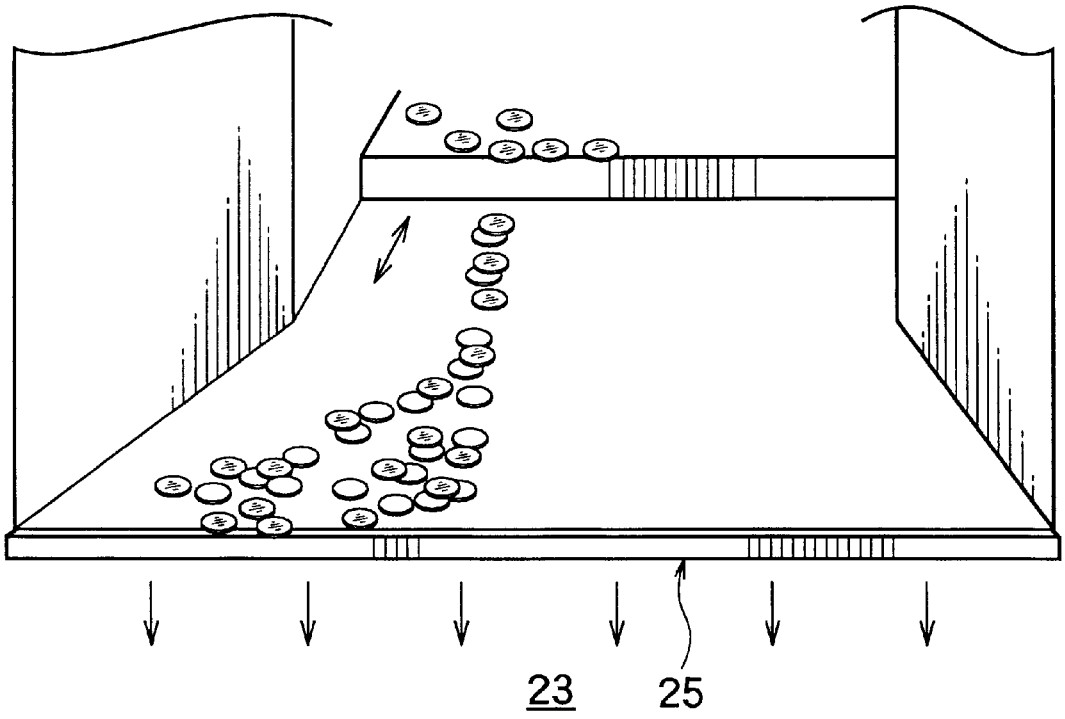
FIG. 3 is a perspective front view showing a part of a table of the game machine of FIG. 2.
Figure 4:
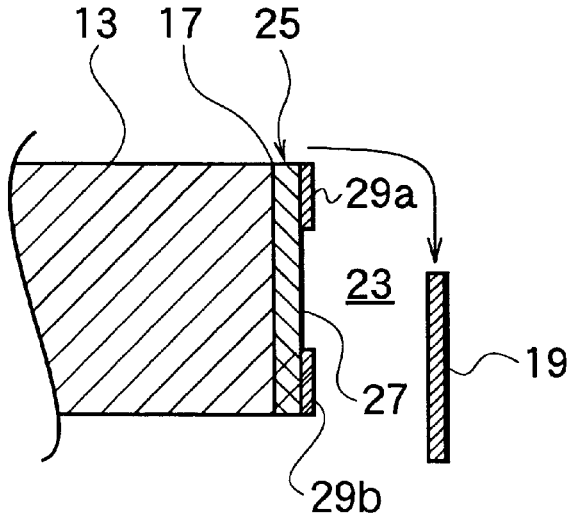
FIG. 4 is a sectional view showing a sensor unit of the present invention installed in the game machine of FIG. 2.

An embodiment of the present invention will be explained with reference to FIGS. 2 to 11 in which FIG. 2 is a perspective view showing a game machine that employs a counter of the present invention, FIG. 3 is a perspective view showing a token table in the game machine, and FIG. 4 is a sectional view showing a token falling edge of the table provided with a sensor unit.

The game machine 11 is a pusher-type game machine and has the token table 13 and a slider 15 arranged behind the table 13. The token falling edge 17 is at a front end of the table 13. In front of the edge 17, there is a path 23 through which tokens fall. A lower part of the path 23 has a hopper shape and is provided with a return mouth 21.

In the game machine 11, the slider 15 reciprocates on the table 13 along an arrow mark A. A player inserts a token into the game machine, and the inserted token falls onto the table 13 at a random position. If lucky, the token effectively transfers the pushing force of the slider 15 forwardly to drop tokens 19 from the edge 17 of the table 13. The dropped tokens 19 enter the return mouth 21.

At this time, the player enjoys the sound made by the falling tokens 19. Namely, the player enjoys a paid-out feeling specific to the pusher-type game machine. A slot of the game machine 11 through which a player inserts a token into the game machine 11 is not shown in the accompanying drawings.

The tokens 19 are uniform objects each having a disk shape and identical dimensions and made of, for example, metal. The tokens 19 may be made of any dielectric material such as plastics, wood, and paper.

The token falling edge 17 of the table 13 is provided with the sensor unit 25. The sensor unit 25 is flat and long and fully extends along the edge 17, to count every token that falls from any part along the edge 17.

Figure 5:
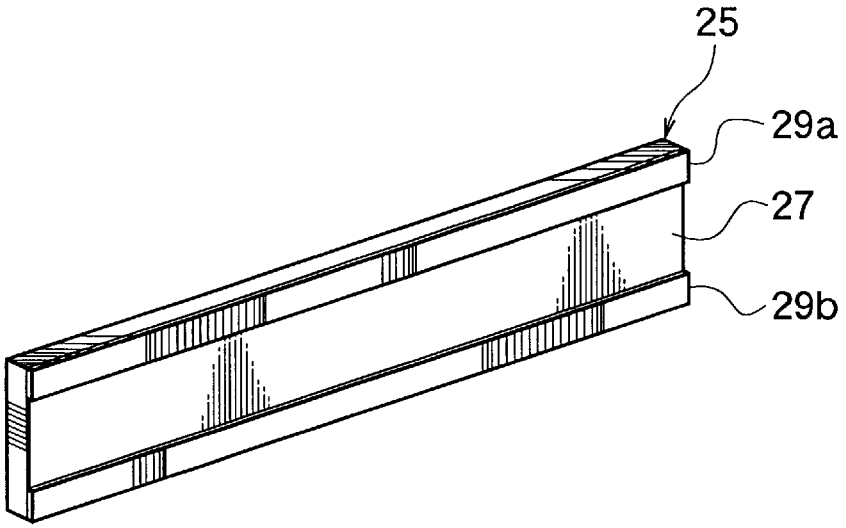
FIG. 5 is a perspective view showing the sensor unit.

The details of the sensor unit 25 are shown in FIGS. 4 and 5. The sensor unit 25 consists of a long dielectric base 27 having a specified dielectric constant and a pair of electrodes 29*a* and 29*b* arranged along upper and lower sides of the base 27, respectively. The sensor unit 25 may be made to fit the length of the edge 17 from the beginning. Instead, the sensor unit 25 may be made longer than the edge 17 and may be cut to fit the length of the edge 17 later.

Since the sensor unit 25 can optionally be cut, it is easily attached to any game machine or any apparatus, to detect randomly falling objects. The sensor unit 25 is versatile.

The sensor unit 25 is attached to an end face of the edge 17 with adhesives or a double-faced tape. Any other fixing means such as screws may be used to detachably fix the sensor unit 25 to the edge 17.

Figure 6:
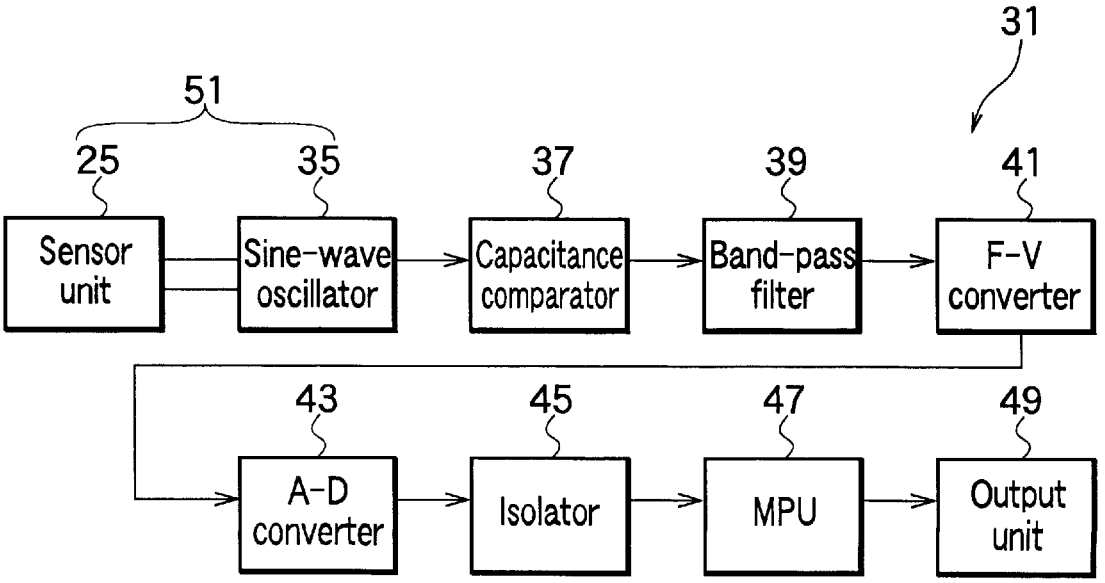
FIG. 6 is a block diagram showing a counter employing the sensor unit.

FIG. 6 is a block diagram showing the counter 31 employing the sensor unit 25 of the present invention installed in the game machine 11. The counter 31 has the sensor unit 25, a sine-wave oscillator 35, a capacitance comparator 37, a band-pass filter 39, an F-V converter 41, an A-D converter 43, an isolator 45, an MPU 47, and an output unit 49.

The sensor unit 25 and sine-wave oscillator 35 form a capacitance sensor 51. The electrodes 29*a* and 29*b* of the sensor unit 25 are connected to the oscillator 35 for generating high-frequency waves so that the electrodes 29*a* and 29*b* may form a high-frequency electric field in the path 23. When a token falls through the path 23, the capacitance of the path 23 increases to increase the amplitude of an oscillated wave. The oscillator 35 provides the comparator 37 with a signal that represents a capacitance change in the path 23.

The comparator 37 stores a reference frequency produced when no metal is present in the path 23. The comparator 37 compares a frequency from the capacitance sensor 51 with the reference frequency and provides the band-pass filter 39 with a comparison result that indicates a frequency increase or a capacitance increase.

The band-pass filter 39 removes noise from the frequency increase. The F-V converter 41 converts the frequency increase into a voltage change, which is converted by the A-D converter 43 into a digital signal representing a binary value. The digital signal is passed through the isolator 45 that is present between an analog section and a digital section, i.e., the MPU 47. The components from the sensor unit 25 to the isolator 45 are incorporated in the game machine 11.

According to the digital signal passed through the isolator 45, the MPU 47 counts the number of falling tokens 19. The MPU 47 serves as an operation unit for comparing a detected capacitance change with a reference capacitance change and determines the number of tokens 19 falling through the path 23. The MPU 47 is installed in, for example, a management center and is properly controlled.

The MPU 47 has a reference memory for storing the reference capacitance change that is measured in advance by dropping a token through the path 23.

The number of tokens counted by the MPU 47 is transferred to the output unit 49, which displays the number or transfers the number to another MPU that controls a payout ratio of the game machine 11. For example, if the number of tokens returned to players increases to increase a payout ratio, a feed of the slider 15 or an inclination of the table 13 may automatically be adjusted to keep a proper payout ratio without boring players or unnecessarily increasing a gambling aspect of the game machine 11.

A capacitance change caused by falling tokens and a technique of counting the number of the falling tokens will be explained.

Figure 7:
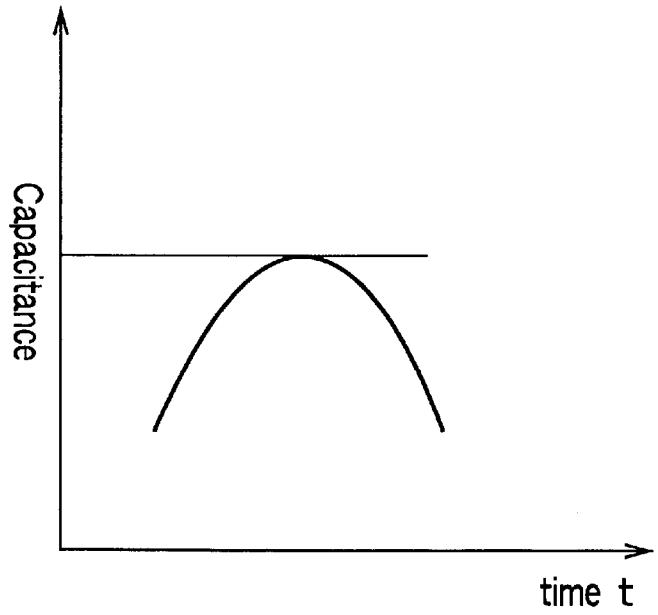
FIG. 7 is a graph showing a capacitance change stored in a memory of the counter.

FIG. 7 shows a capacitance change when a single token falls through the path 23 as shown in FIG. 4. This capacitance change is stored as the reference capacitance change in the MPU 47.

Figure 8:
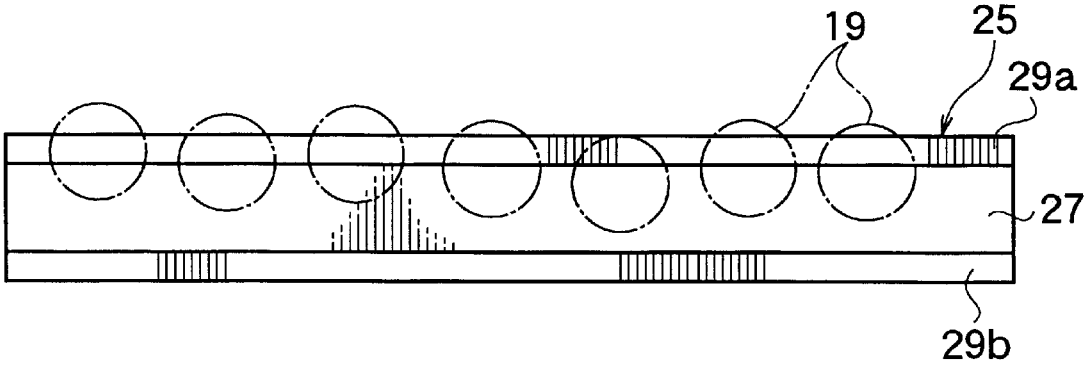
FIG. 8 is a front view showing tokens that fall in a horizontal line in front of the sensor unit.
Figure 9:
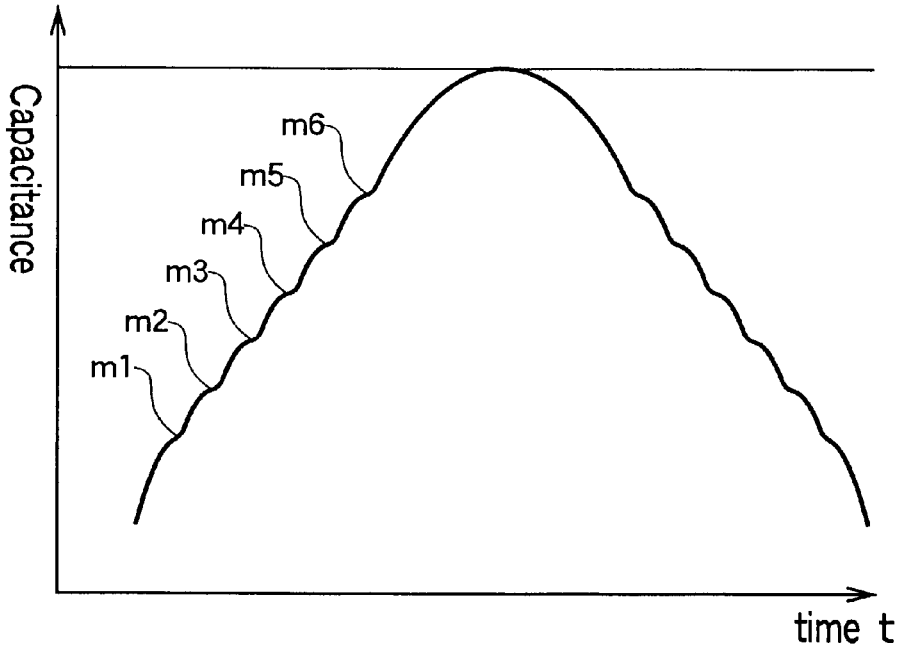
FIG. 9 is a graph showing a capacitance change when tokens fall side by side.

FIG. 8 shows tokens that fall in a line through the path 23, and FIG. 9 shows a capacitance change at this time. Comparing the capacitance change of FIG. 9 with that of FIG. 7, it is possible to determine the number of tokens involved in the capacitance change of FIG. 9.

In FIG. 8, the tokens are not aligned in a straight line but involve time differences from one to another. As a result, the capacitance change of FIG. 9 shows singular points m1 to m6 that correspond to the tokens. The capacitance change may be differentiated to extract the singular points ml to m6 according to which the number of the tokens is correctly determined as seven. If only counting the number of tokens based on singular points, the MPU 47 is not required to have means to compare a detected capacitance change with a reference capacitance change, but it is only required to have means to extract singular points from a detected capacitance change, count the number of the extracted singular points, and determine the number of falling tokens according to the counted number.

Extracting singular points as well as comparing a detected capacitance change with a reference capacitance change may improve the correctness of counting the number of falling tokens. If there are seven tokens horizontally aligned as shown in FIG. 8, there will be six singular points as shown in FIG. 9. In addition, a total capacitance change detected by the sensor unit 25 will correspond to the seven tokens. The detected total capacitance change, however, varies depending on the distances between the electrodes 29*a* and 29*b* of the sensor unit 25 and the tokens. Accordingly, the detected total capacitance change may deviate from that precisely representing seven tokens. Even if the detected total capacitance change is smaller than that precisely corresponding to seven tokens, it must be larger than that corresponding to six tokens. According to the detected total capacitance change and the singular points m1 to m6, it will be determined that the number of tokens is greater than six and equal to or smaller than seven. Namely, it is correctly determined that the number of tokens is seven.

If adjacent two of the seven tokens of FIG. 8 fall under the same conditions, two singular points will overlap so that the capacitance change of FIG. 9 involves five singular points. Even in this case, the total capacitance change indicates that the number of tokens is greater than six, and therefore, it is determined that the number of tokens is greater than six and equal to or smaller than seven. Namely, it is correctly determined that the number of tokens is seven.

If a token overlaps any one of the seven tokens of FIG. 8, there will be eight tokens. In this case, a total capacitance change corresponding to the eight tokens will be detected by the sensor unit 25. Then, according to the total capacitance change and six singular points, it is determined that the number of tokens is greater than seven and equal to or smaller than eight. Consequently, it is correctly determined that the number of tokens is eight.

Figure 10:
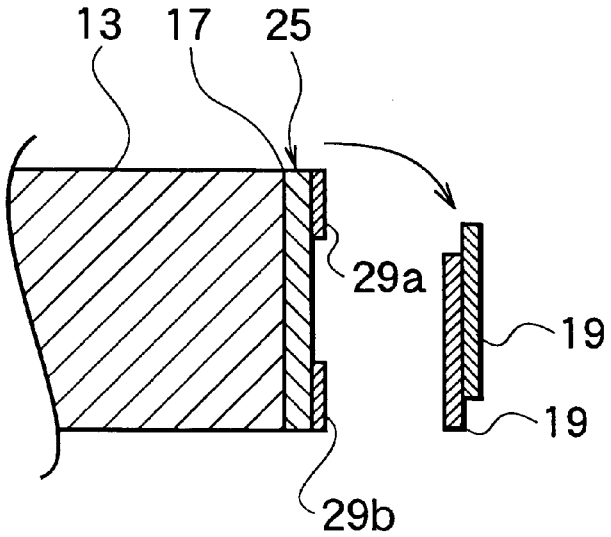
FIG. 10 is a sectional view showing the sensor unit with tokens that partly overlap each other and fall in front of the sensor unit.

FIG. 10 shows two tokens 19 that partly overlap each other and vertically shift from each other when falling in front of the sensor unit 25. In this case, a total capacitance change to be detected by the sensor unit 25 will correspond to two tokens, and there will be a singular point due to the shift between the two tokens. According to the total capacitance change and singular point, it is correctly determined that the number of tokens is two.

Figure 11:
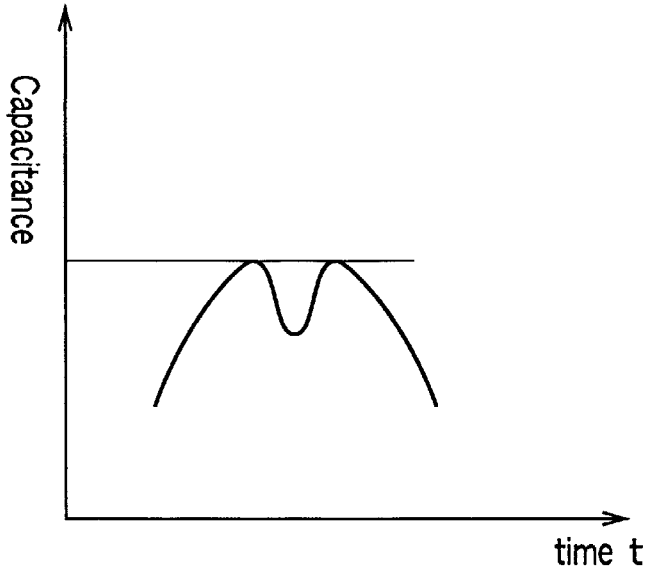
FIG. 11 is a graph showing a capacitance change when a token revolves while falling.

FIG. 11 shows a total capacitance change when a token revolves while falling through the path 23. Only a single token is involved in FIG. 10 for the sake of simplicity of explanation. When a falling token revolves, a total capacitance change caused by the token involves a plurality of peaks. Even with a plurality of peaks, the total capacitance change is substantially equal to the reference capacitance change of FIG. 7, and therefore, it is determined that the number of tokens is one.

Figure 12:
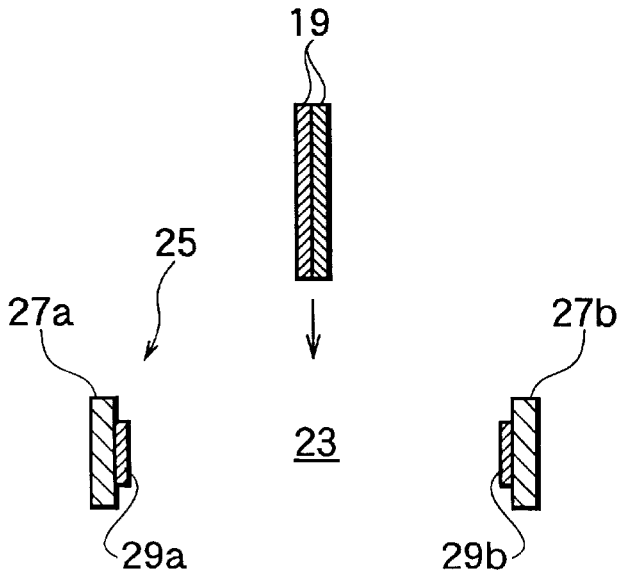
FIG. 12 is a sectional view showing a sensor unit of a counter installed in a game machine according to another embodiment of the present invention.

FIG. 12 shows a sensor unit 25 for the pusher-type game machine 11 (FIG. 2) according to another embodiment of the present invention. The sensor unit 25 has electrodes 29*a* and 29*b* arranged on opposite sides of the path 23 through which tokens fall. The electrodes 29*a* and 29*b* are formed on bases 27*a* and 27*b*, respectively. The base 27*a* is attached to the token falling edge 17 of the table 13 of the game machine 11, and the base 27*b* is attached to a stay that is arranged opposite to the edge 17 in the game machine 11. The bases 27*a* and 27*b* and electrodes 29*a* and 29*b* may be formed to fit the length of the edge 17, or may be formed longer than the edge 17 and cut to fit the length of the edge 17 later.

This embodiment is capable of correctly detecting the number of tokens even if two of them completely overlap each other as shown in FIG. 12.

Although the sensor unit 25 of each embodiment detects tokens, it may detect other objects such as coins.

Various modifications will become possible for those skilled in the art after receiving the teachings of the present disclosure without departing from the scope thereof.

What is claimed is:

1. A counter comprising:

a capacitance sensor having a sensor unit arranged in a path where uniform objects fall, for detecting a capacitance change in the path;

memory means for storing a reference capacitance change that occurs when a single object falls through the path; and operation means for comparing a capacitance change detected by the capacitance sensor with the reference capacitance change and determining the number of objects falling through the path according to a result of the comparison.

2. The counter of claim 1, wherein the operation means compares a total capacitance change detected by the capacitance sensor with the reference capacitance change.

3. The counter of claim 2, wherein the operation means extracts singular points from the total capacitance change, counts the number of the extracted singular points, and determines the number of falling objects according to the counted number and a result of the comparison.

4. A counter comprising:

a capacitance sensor having a sensor unit arranged in a path through which uniform objects fall, for detecting a capacitance change in the path; and operation means for extracting singular points from the detected capacitance change, counting the number of the extracted singular points, and determining the number of objects falling through the path according to the counted number.

5. The counter of claim 1, wherein the sensor unit comprises a long dielectric base having a specified dielectric constant and electrodes attached to the dielectric base along the length thereof.

6. The counter of claim 2, wherein the sensor unit comprises a long dielectric base having a specified dielectric constant and electrodes attached to the dielectric base along the length thereof.

7. The counter of claim 3, wherein the sensor unit comprises a long dielectric base having a specified dielectric constant and electrodes attached to the dielectric base along the length thereof.

8. The counter of claim 4, wherein the sensor unit comprises a long dielectric base having a specified dielectric constant and electrodes attached to the dielectric base along the length thereof.

9. The counter of claim 1, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

10. The counter of claim 2, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

11. The counter of claim 3, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

12. The counter of claim 4, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

13. The counter of claim 5, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

14. The counter of claim 6, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

15. The counter of claim 7, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance change in the path when the tokens fall through the path.

16. The counter of claim 8, wherein:

the path is defined along a token falling edge of a table in a game machine;

the sensor unit of the capacitance sensor is arranged at the token falling edge;

the falling objects to be detected by the capacitance sensor are tokens that are pushed and dropped from the token falling edge of the table; and the capacitance sensor detects a capacitance chance in the path when the tokens fall through the path.

* * * * *